US006900591B2

(12) United States Patent
Huang et al.

(10) Patent No.: US 6,900,591 B2
(45) Date of Patent: May 31, 2005

(54) DRIVING ELECTRODE STRUCTURE OF PLASMA DISPLAY PANEL

(75) Inventors: Wen-Rung Huang, Taipei (TW); Hsu-Pin Kao, Taipei (TW); Yu-Ju Chen, Taipei (TW); Ching-Chung Cheng, Taipei (TW); Yen-Ting Shen, Taipei (TW)

(73) Assignee: Chunghwa Picture Tubes, Ltd. (TW)

( * ) Notice: Subject to any disclaimer, the term of this patent is extended or adjusted under 35 U.S.C. 154(b) by 35 days.

(21) Appl. No.: 10/372,291

(22) Filed: Feb. 25, 2003

(65) Prior Publication Data

US 2004/0113556 A1 Jun. 17, 2004

(30) Foreign Application Priority Data

Dec. 16, 2002 (TW) ..... 91136312 A

(51) Int. Cl.[7] ..... H01J 17/49

(52) U.S. Cl. ..... 313/582; 313/584; 313/585; 313/586; 313/631; 313/587

(58) Field of Search ..... 313/582–587, 313/631

(56) References Cited

U.S. PATENT DOCUMENTS 6,348,762 B1 * 2/2002 Nunomura et al. ..... 313/582
6,630,788 B1 * 10/2003 Park ..... 313/582
6,642,653 B1 * 11/2003 Hirano et al. ..... 313/582

* cited by examiner

*Primary Examiner*—Vip Patel
*Assistant Examiner*—Sikha Roy

(57) ABSTRACT

A driving electrode structure of a plasma display panel for improving operation margin is described. A plurality openings is formed in a transparent electrode according to the driving characteristics of fluorescent layer of each luminous cell to adjust the effective area of the transparent electrode in each luminous cell, thereby increasing the operation margin of the sustaining voltage.

21 Claims, 3 Drawing Sheets

DRIVING ELECTRODE STRUCTURE OF PLASMA DISPLAY PANEL

BACKGROUND OF THE INVENTION

1. Field of Invention

The present invention relates to a plasma display panel (PDP). More particularly, the present invention relates to a driving electrode structure of the PDP for improving operation margin of driving voltage.

2. Description of Related Art

User demand for entertainment equipment is growing due to the rapid development of multimedia applications. Conventionally, the cathode ray tube (CRT) display, a type of monitor, is commonly used. However, the cathode ray tube display does not meet the needs of multimedia technology because it has a large volume. Many flat panel display techniques such as liquid crystal display (LCD), plasma display panel (PDP), and field emission display (FED) have been recently developed in response to the needs of multimedia technology. These display techniques can manufacture a thin, light, short and small monitor, and thus these techniques are becoming the mainstream technology for the future. Of these techniques, the plasma display panel (PDP) is attracting attention in the field of displays as a full-color display apparatus having a large size display area and is especially popularly for use in large-size televisions or outdoor display panels.

A color PDP is a display in which ultraviolet rays are produced by gas discharge to excite phosphorus so that visible lights are emitted therefrom to perform a display operation. Depending upon a discharge mode, the color PDP is classified as an alternating current (AC) or a direct current (DC) type. In the AC-type PDP, an electrode is covered with a protective layer. The AC-type PDP has such characteristics that it inherently has a long life and a high brightness. Therefore, the AC-type PDP is generally superior to the DC-type PDP in luminance, luminous efficiency and lifetime. Generally, a 3-electrode type PDP including a common electrode, a scan electrode and an address electrode is employed in the AC-type PDP. The 3-electrode-type is directed to a surface discharge-type and is switched or sustained based on a voltage applied to the address electrode installed on a lateral surface of a discharge cell.

Common and scan electrodes disposed on an image display side substrate are generally formed of a transparent electrode made of a glass material for implementing a certain transmittivity of visual rays. The transparent electrode material is a semiconductor typically formed of ITO (e.g., a mixture of indium oxide $In_2O_3$ and tin oxide $SnO_2$). The conductivity of the transparent electrode is relatively low in comparison with that of metal, and a fine conductive metal layer with narrow width is therefore added as the bus electrode on the transparent electrode to enhance the conductivity thereof.

In a color plasma display panel, fluorescent layers coated on an inner wall of each luminous cell convert the ultraviolet rays into light of three primary colors, such as red (R), green (G) and blue (B). A pulse writing voltage is applied to accumulate discharge charges for discharging on the surface of a protective layer covering the transparent electrodes during the light discharge process. Nevertheless, most accumulated charges are consumed at the moment of discharge, and thus a pulse sustaining voltage is needed for the luminous cells to provide required discharging charges for continuous luminance.

When the red, green and blue fluorescent layers are used in a plasma display panel, the sustaining voltage of each fluorescent layer has its driving range because of respective driving characteristics. If a conventional driving electrode structure with a bar transparent electrode and a strip bus electrode is employed, the sustaining voltage must be in the overlaid driving range of the three primary color cells to drive each respective color cell. The driving stability thus cannot be improved and the luminance conditions are consequently limited. For stable illumination, the conventional discharging-luminance structure must be more strictly fabricated, and the process windows for the structure are therefore limited. Hence, there is a requirement for enlarging the operation margin of the sustaining voltage.

SUMMARY OF THE INVENTION

It is therefore an object of the present invention to provide a driving electrode structure of a plasma display panel, in which a plurality of adjusting openings are formed in the transparent electrodes according to respective color fluorescent layer to adjust the effective area for each luminous cell. The driving range of sustaining voltage for respective color luminous cells is shifted approximatively to enlarge operation margin of the sustaining voltage by producing different wall charge accumulations for respective luminous cells under the same sustaining voltage.

In one aspect, the present invention provides a driving electrode structure of a plasma display panel formed on a substrate to drive a plurality of parallel-arranged luminous cells. The driving electrode structure comprises a comb electrode and a transparent electrode with a plurality of adjusting openings. The comb electrode includes a main line across the parallel-arranged luminous cells and a plurality of branches perpendicularly expanded from the main line and located between the adjacent luminous cells. The transparent electrode is parallel to the main line of the comb electrode, and electrically coupled to the branches of the comb electrode. The transparent electrode has a plurality of adjusting openings therein. Each adjusting opening is located corresponding to one branch and laterally expands an adjusting width to the portion between two adjacent adjusting openings to obtain an effective electrode width.

The adjusting width is modified according to the driving characteristic of each color fluorescent layer in the luminous cell. For example, if red, blue and green luminous cells are employed, the adjustment width of the red luminous cell is wider than that of the blue luminous cell, and simultaneously the adjusting width of the blue luminous cell is wider than that of the green luminous cell. Consequently, the green luminous cell obtains a widest effective electrode width, and the red luminous cell obtains a narrowest effective electrode width, relatively. By obtaining this structure, each driving range of the color luminous cells is shifted approximatively, so that the operation margin of the sustaining voltage is enlarged to improve operation stability.

BRIEF DESCRIPTION OF THE DRAWINGS

These and other features, aspects, and advantages of the present invention will become better understood with regard to the following description, appended claims, and accompanying drawings, wherein:

DESCRIPTION OF THE PREFERRED EMBODIMENTS

The present invention provides a driving electrode structure of a plasma display panel (PDP). A plurality of adjusting openings is formed in a transparent electrode. The width of the adjusting opening is adjusted according to the driving characteristic of fluorescent layer in each luminous cell to vary the wall charge accumulation on the surface of protective layer in respective luminous cell, and thereby to enlarge the operation margin of sustaining voltage.

Figure 1:
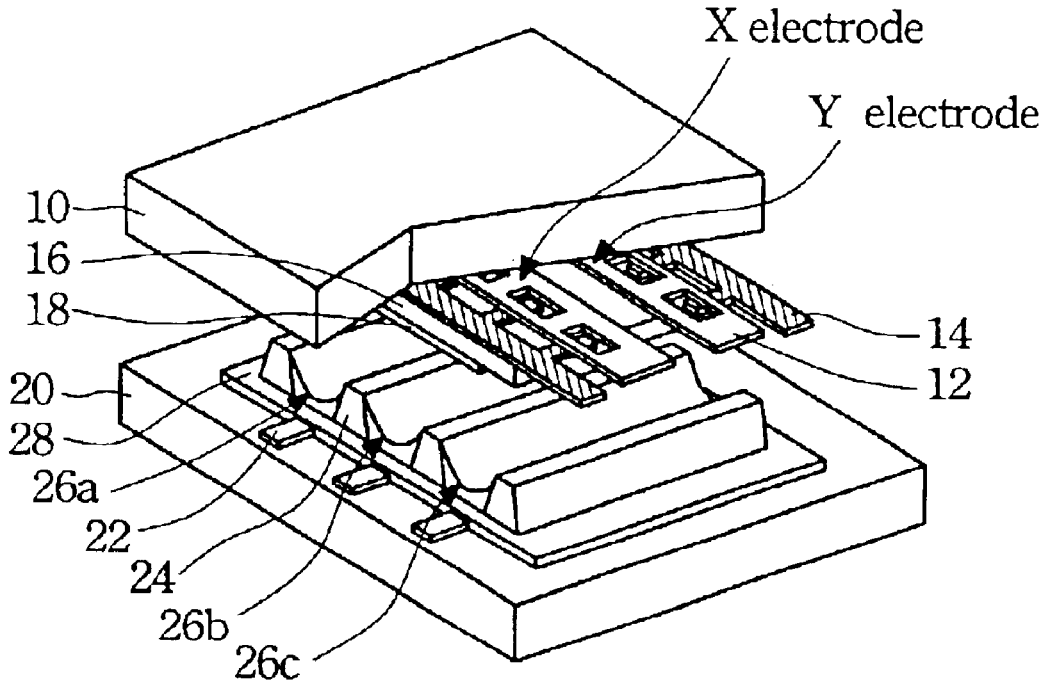
FIG. 1 is a schematic perspective view of a display panel according to the present invention.

FIG. 1 is a schematic perspective view of a display panel according to the present invention. Referring to FIG. 1, the display panel of PDP according to the present invention at least comprises a front substrate 10 and a back substrate 20. Both of the front and back substrates 10, 20 are a transparent substrate, such as a soda lime glass substrate or a high stain point glass substrate. A plurality of parallel address electrodes 22 generally formed by a high conductivity material, such as a silver (Ag) or aluminum (Al), is formed on the back substrate 20. A dielectric layer 28 is formed over the substrate 20 to cover the address electrodes 22. The dielectric layer 28 can be made of a low melting point glass. A plurality of parallel barrier ribs located between the address electrodes 22 is formed on the dielectric layer 28. Of course, the barrier ribs 24 are not limited to the strip-like barrier ribs as shown in FIG. 1, and can be modified to different kinds of shapes to isolate required discharge space for a luminous cell.

On the rear side of the front substrate 10, a plurality of conductive electrodes in pairs is formed on each row of luminous cells, and perpendicular to the address electrodes. Each pair of the conductive electrodes includes a common electrode and a scan electrode, i.e. the X electrode and Y electrode illustrated in FIG. 1, to construct the required electrodes for each luminous cell. Each pair of the conductive electrodes is composed of a pair of transparent electrodes 12 and a pair of comb electrodes 14. A dielectric layer 16 and a protect layer 18 are formed sequentially to cover the transparent electrodes 12 and comb electrodes 14. The transparent protective layer 18 can be made of magnesium oxide (MgO) to protect the conductive layers. Therefore, the conductive layers can be protected without damages during the discharging proceeding to extend the lifetime of the conductive electrodes.

Fluorescent layers of three primary colors 26*a*, 26*b*, 26*c* are coated between the barrier ribs 24, and three luminous cells including the three primary colors compose an image pixel. The general primary colors include a system of red (R), green (G) and blue (B). Of course, other system of primary colors can be employed in the present invention without limited herein. If a RGB system is used, the red fluorescent layer can be made of yttrium gadolinium borate: europium ((Y, Gd)$BO_3$: Eu). The green fluorescent layer can be made of zinc sulfate: manganese ($Zn_2SO_4$: Mn). The blue fluorescent layer can be made of barium magnesium aluminate: europium ($BaMgAl_{10}O_{17}$: $Eu^{2+}$). The ultraviolet rays produced in the luminous cells by gas discharging from the crossed electrodes of the front and back substrates 10, 20 irradiate the fluorescent layers 26*a*, 26*b*, 26*c* to emit red, green and blue lights for mixing the required colors.

Figure 2:
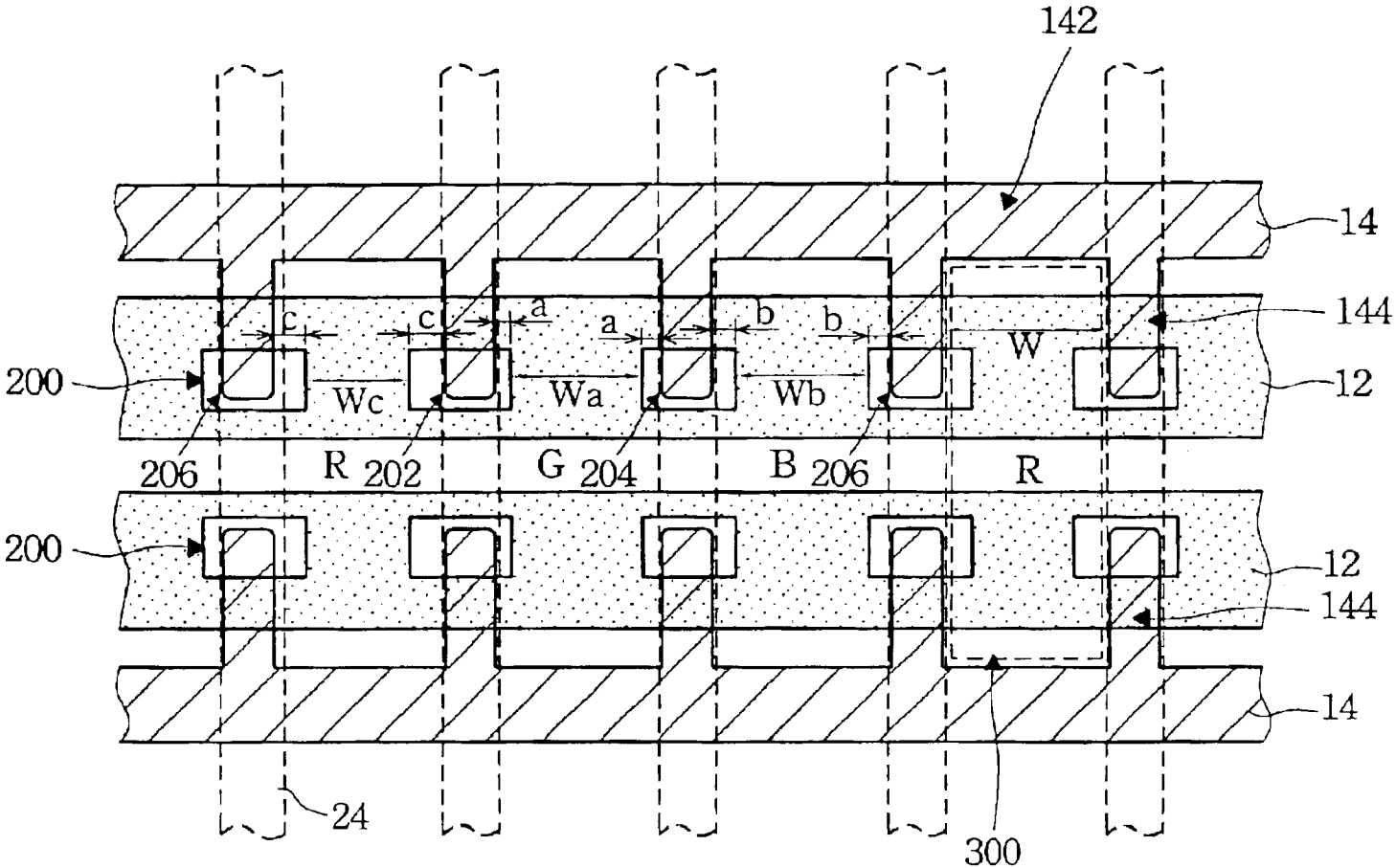
FIG. 2 is a schematic top view of a driving electrode structure according to the present invention.

The conventional transparent electrodes and bus electrodes are in the form of strips, so that the driving ranges of each primary color luminous cell are different. The overlaid driving range of the three primary colors is therefore narrowed, and results in a small operation margin. Hence, the conventional electrode structure has a big operation limitation. The present invention provides an improved electrode structure that can enlarge the operation margin of driving voltage and increase product stability. FIG. 2 is a schematic top view of driving electrodes according to the present invention. The driving electrodes are formed on the rear side of the front substrate 10, and disposed symmetrically. Referring to FIG. 2, each driving electrode includes a comb electrode 14 and a transparent electrode 12. For a three-electrode structure, a pair of transparent electrodes 12 and a pair of comb electrodes 14 are set on the opposite sides of the luminous cell. The pair of comb electrodes 14 is symmetrically disposed on both sides of the luminous cell, and in combination with the crossed barrier ribs 24 to form row arranged luminous cells 300. Every three adjacent luminous cells 300, respectively coated with three primary color fluorescent layers R, G, B, constitute an image pixel.

Each comb electrode 14 includes a main line 142 across row arranged luminous cells 300. The main line 142 is connected to a signal supply circuit (not shown), to control the light of specific luminous cell. A plurality of branches 144 is perpendicularly extended from and between the pair of main lines 142. Each of the branches 144 is located between two adjacent luminous cells 300 in row, and aligns the underneath barrier ribs 24. Therefore, the opaque branches 144 do not shield the light emitted from the luminous cells 300. The main lines 142 and branches 144 are made of opaque and high conductivity materials. For example, The main lines 142 and branches 144 can be made of aluminum, cobalt, silver, molybdenum, chromium, tantalum, tungsten, iron, copper, or an alloy or a combination thereof, and be preferably made of a conductive anti-reflective material, such as black silver. The end of the branches 144 approximates the discharge center of the luminous cells 300 between the pair of main lines 142. The branches 144 assist to the electric field inside the luminous cells 300 becomes more uniformly to obtain high uniform radiation lights.

A pair of transparent electrodes 12 is formed between a pair of comb electrodes 14. The transparent electrode 12 is composed of transparent conductive material, such as indium tin oxide (ITO), or indium zinc oxide (IZO). The transparent electrodes 12 and the main lines 142 of the comb electrodes 14 are parallel arranged. The transparent electrodes 12 are preferably electrically connected to the branches 144 without main lines 142. Consequently, smaller area can be used for the transparent electrodes 12 to prevent parasitic capacitance therein.

A plurality of adjusting openings 200 including openings 202, 204, 206 is formed in the transparent electrodes 12 to adjust an effective electrode width in each luminous cell 300. As shown in FIG. 2, each adjusting opening 200 aligns with one branch 144 of the comb electrode 144, and has an adjusting width a, b and c, corresponding to the adjacent luminous cells 300. A RBG system is used as an example. In a red luminous cell R, each of the adjusting openings 202 and 206 adjacent to the red luminous cell R respectively has an adjusting width c, so that the effective electrode width Wc of the transparent electrode 12 is equal to the cell width W minus the two adjusting widths c. Similarly, each of the adjusting openings 202 and 204 adjacent to the green luminous cell G has an adjusting width a, so that the effective electrode width Wa of the transparent electrode is equal to W−2a. In a blue luminous cell B, the effective electrode width Wb is equal to W−2b. The resulting effective electrode widths Wa, Wb, Wc are modified according to the driving characteristics of the fluorescent layers. For example, if a RGB system is employed, the driving difficulty of the luminous cells is green>blue>red. Consequently, the design of the adjustment widths is c>b>a, and thus the effective electrode widths are Wa>Wb>Wc. During the light discharge process, wall charges are accumulated on the surface of the protect layer 18 covering the transparent electrodes 12. The accumulation of the wall charges is in direct proportion to the effective electrode width Wa, Wb, Wc, and thereby adjust the driving voltage for the discharge process.

Figure 3:
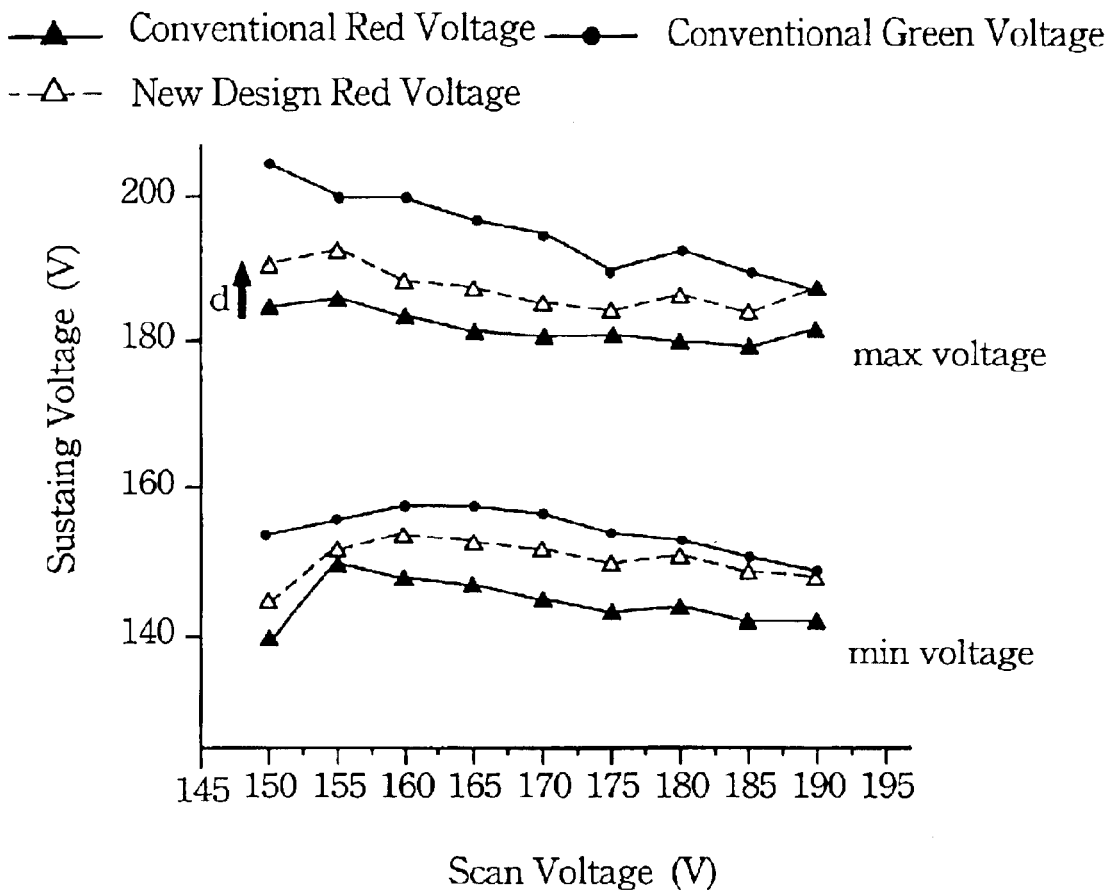
FIG. 3 is a diagram of a sustaining voltage corresponding to a scan voltage according to a driving electrode structure of the present invention in comparison with that of a conventional driving electrode structure.

By modifying the adjusting openings 202, 204, 206 to change the effective electrode widths Wa, Wb, Wc, the operation margin of driving voltage can be enlarged, especially in sustaining voltage. A large operation margin makes the discharging luminance action of the luminous cell become more stable. FIG. 3 is a diagram of a sustaining voltage corresponding to a scan voltage according to a driving electrode structure of the present invention in comparison with a conventional driving electrode structure. Referring to FIG. 3, a pulse writing voltage, also known as a scan voltage, is used to decide the luminance of a specific luminous cell. When a scan voltage is applied to a specific luminous cell for discharge, most accumulated wall charges are consumed at the moment of discharge, so a pulse sustaining voltage, referred to a sustaining voltage, is subsequently applied to provide the required charges for continuous luminance. Since the red, green and blue fluorescent layers respectively have a driving characteristic, each color luminous cell has its driving range. As shown in FIG. 3, the sustaining voltage applied to the green luminous cell must be in the range between the maximum voltage and minimum voltage to obtain continuous luminance. If the sustaining voltage is out of this range, the luminance cell does not light and becomes a malfunctioning point. Similarly, the red luminous cell has its driving range, which is relatively lower than the green luminous cell. Therefore, the operation margin is between the maximum voltage of red and minimum voltage of green for a conventional driving voltage. This small operation margin limits the operation of the sustaining voltage and thus reduces the operation stability. Under a normal usage of the plasma display panel, the operation margin is narrowed corresponding to the use time, which limits the product lifetime.

The present invention utilizes the adjusting openings 202, 204, 206 to adjust the effective electrode width Wa, Wb, Wc in the luminous cells R, G, and B. If a conventional strip-like driving electrode structure is employed, the driving voltage for each luminous cell cannot be modified due to fixed effective electrode width. In contrast, the present invention utilizes the adjusting openings 202, 204, 206 in the transparent electrode 12 for adjusting the effective electrode width Wa, Wb, Wc to obtain different wall charge accumulations. By narrowing the effective electrode width Wc of red luminous cell R, the driving range of the red luminous cell R is elevated. As shown in FIG. 3, the sustaining voltage of red is shifted, i.e. the maximum and minimum voltages are both elevated, to approximate the sustaining voltage of green, so that the overlapping range between the red and green sustaining voltages increases range d. Simultaneously, the driving range of the sustaining voltage of blue luminous cell B is elevated to approximate that of green luminous cell G, at this time, all of the red, green and blue luminous cells R, G, B have the same driving ranges. Therefore, a largest operation margin can be obtained according to the driving electrode structure of the present invention.

When a continuous luminance operation is performed, equal sustaining voltage is applied to the red, green and blue luminous cells R, G, B. By adjusting the driving ranges of the red, green and blue luminous cells R, G, B, the operation margin of the sustaining voltage according to the present invention is enlarged. Accordingly, the stability of luminance can be improved and the lifetime of the PDP can be increased. In addition, the design for a circuit control can be more flexible, and the process widow for fabricating the luminous cells can be increased.

According to above description, the present invention can enlarge the operation margin by adjusting the effective electrode width according to the driving characteristic of each fluorescent layer. The stability of luminance can be improved. The lifetime of the display panel can be extended and the process window can be improved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A driving electrode structure of a plasma display panel formed on a substrate to drive a plurality of luminous cells in row, comprising:

a comb electrode including a main line and a plurality of branches, said main line being located across said luminous cells, and said branches extending perpendicularly from said main line and being located between said luminous cells; and a transparent electrode parallel to said main line of said comb electrode and electrically connected to said branches of said comb electrode, said transparent electrode having a plurality of adjusting openings, and each of said adjusting openings being aligned to one of said branches and extending an adjusting width to a portion of said transparent electrode between said adjacent adjusting openings to obtain an effective electrode width therebetween.

2. The structure according to claim 1, wherein said comb electrode is made of a conductive anti-reflective material.

3. The structure according to claim 1, wherein a material of said comb electrode is selected from the group consisting of aluminum, cobalt, silver, molybdenum, chromium, tantalum, tungsten, iron, copper and a combination thereof.

4. The structure according to claim 1, wherein a material of said transparent electrode comprises indium tin oxide.

5. The structure according to claim 1, wherein said adjusting width is modified according to a driving characteristic of a fluorescent layer inside said luminous cell between said adjacent adjusting openings.

6. The structure according to claim 5, wherein said fluorescent layer is a red fluorescent layer, a green fluorescent layer or a blue fluorescent layer.

7. The structure according to claim 6, wherein said adjusting width for said red fluorescent layer is larger than that for said blue fluorescent layer, and said adjusting width for said blue fluorescent layer is larger than that for said green fluorescent layer.

8. The structure according to claim 7, wherein sustaining voltage driving ranges of said luminous cells having said red, blue and green fluorescent layers are substantially equal.

9. A driving electrode structure of a plasma display panel formed on a substrate having a plurality of pixels in row, each pixel at least including first, second and third luminous cells, and said driving electrode structure being used to drive said luminous cells, comprising:

a comb electrode including a main line and a plurality of branches, said main line being located across said luminous cells, and said branches extending perpendicularly from said main line and being located between said luminous cells; and a transparent electrode parallel to said main line of said comb electrode being electrically connected to said branches of said comb electrode, said transparent electrode having a plurality of adjusting openings, each of said adjusting openings aligning to one of said branches and extending first, second and third adjusting widths to said first, second and third luminous cells, respectively.

10. The structure according to claim 9, wherein said comb electrode is made of a conductive anti-reflective material.

11. The structure according to claim 9, wherein a material of said comb electrode is selected from the group consisting of aluminum, cobalt, silver, molybdenum, chromium, tantalum, tungsten, iron, copper and a combination thereof.

12. The structure according to claim 9, wherein a material of said transparent electrode comprises indium tin oxide.

13. The structure according to claim 9, wherein said first, second and third luminous cells have red, blue and green fluorescent layers, respectively.

14. The structure according to claim 13, wherein said first adjusting width for said red fluorescent layer is larger than said second adjusting width for said blue fluorescent layer, and said second adjusting width for said blue fluorescent layer is larger than said third adjusting width for said green fluorescent layer.

15. The structure according to claim 14, wherein sustaining voltage driving ranges of said first, second and third luminous cells are substantially equal.

16. A driving electrode structure of a plasma display panel formed on a substrate having a plurality of pixels in row, each pixel at least including red, blue and green luminous cells, and said driving electrode structure being used to drive said luminous cells, comprising:

a pair of comb electrodes symmetrically arranged on both sides of said luminous cells, each of said comb electrode including a main line and a plurality of branches, said pair of main lines across said luminous cells being located on both sides of said luminous cells, said branches perpendicularly extending from and between said pair of main lines and being located between said luminous cells; and a pair of transparent electrodes located between and parallel to said pair of main lines, said pair of transparent electrodes being electrically connected to said branches of said pair of comb electrodes, each of said transparent electrodes having a plurality of adjusting openings, each of said adjusting openings aligning to one of said branches and extending first, second and third adjusting widths to said red, blue and green luminous cells, respectively.

17. The structure according to claim 16, wherein said comb electrode is made of a conductive anti-reflective material.

18. The structure according to claim 16, wherein a material of said comb electrode is selected from the group consisting of aluminum, cobalt, silver, molybdenum, chromium, tantalum, tungsten, iron, copper and a combination thereof.

19. The structure according to claim 16, wherein a material of said transparent electrode comprises indium tin oxide.

20. The structure according to claim 16, wherein said first adjusting width for said red fluorescent layer is larger than said second adjusting width for said blue fluorescent layer, and said second adjusting width for said blue fluorescent layer is larger than said third adjusting width for said green fluorescent layer.

21. The structure according to claim 16, wherein sustaining voltage driving ranges of said red, blue and green luminous cells are substantially equal.

* * * * *